US011414805B2

(12) United States Patent
Chun et al.

(10) Patent No.: US 11,414,805 B2
(45) Date of Patent: Aug. 16, 2022

(54) WASHING MACHINE

(71) Applicant: SAMSUNG ELECTRONICS CO., LTD., Suwon-si (KR)

(72) Inventors: Kwangmin Chun, Suwon-si (KR); Baekgyu Kwon, Suwon-si (KR); Mangon Kim, Suwon-si (KR); Jong-Hun Sung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

(21) Appl. No.: 16/881,289

(22) Filed: May 22, 2020

(65) Prior Publication Data

US 2020/0370223 A1 Nov. 26, 2020

(30) Foreign Application Priority Data

May 24, 2019 (KR) ..... 10-2019-0061064

(51) Int. Cl.

| | |
|---|---|
| ***D06F 37/22*** | (2006.01) |
| ***D06F 39/12*** | (2006.01) |
| ***D06F 37/20*** | (2006.01) |
| ***D06F 37/24*** | (2006.01) |

(52) U.S. Cl.

CPC ..... *D06F 37/22* (2013.01); *D06F 37/20* (2013.01); *D06F 39/12* (2013.01); *D06F 37/24* (2013.01); *D06F 39/125* (2013.01)

(58) Field of Classification Search

CPC ..... D06F 37/20; D06F 37/22; D06F 37/24; D06F 39/12

See application file for complete search history.

(56) References Cited

U.S. PATENT DOCUMENTS

| | | | | |
|---|---|---|---|---|
| 3,321,940 A * | 5/1967 | Brucken | ..... | D06F 37/20 68/23.3 |
| 4,991,412 A * | 2/1991 | Bauer | ..... | D06F 37/20 210/144 |
| 5,613,380 A * | 3/1997 | Savkar | ..... | D06F 37/24 68/23.3 |
| 2005/0183472 A1* | 8/2005 | Choi | ..... | D06F 37/22 68/23.1 |
| 2005/0193779 A1* | 9/2005 | Kwon | ..... | D06F 37/22 68/23.1 |

(Continued)

FOREIGN PATENT DOCUMENTS

EP 1 760 183 B1 3/2012

*Primary Examiner* — Joseph L. Perrin
(74) *Attorney, Agent, or Firm* — Staas & Halsey LLP

(57) ABSTRACT

Disclosed is a washing machine having an improved structure of a damper. The washing machine includes a main body in which a tub is installed, a damper provided in the main body to support the tub, and a damper fixing member provided on a bottom plate of the main body to fix the damper, wherein the damper fixing member includes a fixing bolt, a first flange portion formed on at least a portion of the bottom plate to support one side of a lower end of the damper and provided with a through hole through which the fixing bolt passes, and a second flange portion formed to face the first flange portion to support the other side of the lower end of the damper and provided with a coupling portion to which the fixing bolt is fastened, and wherein at least one of the first flange portion and the second flange portion comprises a reinforcing rib to reinforce strength.

20 Claims, 7 Drawing Sheets

(56) References Cited

U.S. PATENT DOCUMENTS

2007/0044518 A1* 3/2007 Lee ..... D06F 37/20
68/23.1
2020/0024789 A1* 1/2020 Guzman ..... D06F 39/085

* cited by examiner

WASHING MACHINE

CROSS-REFERENCE TO RELATED APPLICATION(S)

This application is based on and claims priority under 35 U.S.C. § 119 to Korean Patent Application No. 10-2019-0061064, filed on May 24, 2019, in the Korean Intellectual Property Office, the disclosure of which is incorporated by reference herein in its entirety.

BACKGROUND

1. Field

The disclosure relates to a washing machine, and more particularly, to a washing machine having an improved structure of a damper fixing member.

2. Description of Related Art

Generally, a washing machine is a device for washing laundry by rotating a cylindrical rotary tub containing the laundry and washing water. As a type of washing machine, there are a drum washing machine in which laundry is washed by falling down after being lifted upward along an inner circumferential surface of a rotary tub as the rotary tub, which is disposed substantially horizontally, rotates in the forward and reverse directions with respect to a horizontal axis, and a vertical axis washing machine in which laundry is washed using a water current generated by a pulsator disposed inside a rotary tub as the rotary tub, which is disposed substantially vertically, rotates in the forward and reverse directions with respect to a vertical axis.

A drum washing machine is provided with a damper for damping vibration and shaking generated in a tub while supporting a lower portion of the tub. An upper end of the damper is coupled to a lower portion of the tub and a lower end of the damper is fixed to a bottom plate of a washing machine body, and the damper dampens vibration and shaking generated in the tub by its own expanding and contracting actions.

A washing machine is provided with a damper fixing member on a bottom plate of a main body such that a lower end of a damper may be fixed, and the lower end of the damper and the damper fixing member are mutually coupled through fastening of a fixing bolt. However, when a fastening force of the damper fixing member increases, uneven deformation may occur depending on a thickness of the bottom plate.

In addition, the fastening of the damper fixing member may make secureness of the cost competitiveness by thickness reduction of the bottom plate difficult and may cause problems such as unfastening, wear, and abnormal vibration or noise.

SUMMARY

It is an aspect of the disclosure to provide a washing machine with an improved damper fixing member structure.

It is an aspect of the disclosure to provide a washing machine capable of improving vibration and noise by stably maintaining the fastening of a damper fixing member.

It is an aspect of the disclosure to provide a washing machine capable of securing the cost competitiveness by thickness reduction by reinforcing the strength of a damper fixing member.

Additional aspects of the disclosure will be set forth in part in the description which follows and, in part, will be obvious from the description, or may be learned by practice of the disclosure.

In accordance with an aspect of the disclosure; a washing machine includes a main body in which a tub is installed, a damper provided in the main body to support the tub, and a damper fixing member provided on a bottom plate of the main body to fix the damper, wherein the damper fixing member includes a fixing bolt, a first flange portion formed on at least a portion of the bottom plate to support one side of a lower end of the damper and provided with a through hole through which the fixing bolt passes, and a second flange portion formed to face the first flange portion to support the other side of the lower end of the damper and provided with a coupling portion to which the fixing bolt is fastened, and wherein at least one of the first flange portion and the second flange portion comprises a reinforcing rib to reinforce strength.

The reinforcing rib may be formed by protruding at least a portion of at least one of the first flange portion and the second flange portion.

The coupling portion may include threads to fasten the fixing bolt.

The coupling portion may include a support surface to support the fixing bolt.

The reinforcing rib may be integrally formed with the second flange portion.

The reinforcing rib may be positioned at an upper portion of the second flange portion and may protrude horizontally.

The reinforcing rib may include a first rib horizontally positioned at an upper portion of the second flange portion and a second rib extending vertically from opposite ends of the first rib.

The reinforcing rib may include at least one of an I shape and a U shape.

The reinforcing rib may include at least one of a square cross-sectional shape and a circular cross-sectional shape.

Thicknesses t1 and t2 of the first flange portion and the second flange portion may be 1.2 mm or less.

A thickness t of the bottom plate may be 1.2 mm or less.

The reinforcing rib may be positioned above the coupling portion.

The reinforcing rib may be disposed around the coupling portion.

The reinforcing rib may be formed by a press process on at least one of the first flange portion and second flange portion.

In accordance with another aspect of the disclosure, a washing machine includes a main body in which a tub is installed, a damper provided in the main body to support the tub, and a damper fixing member provided on a bottom plate of the main body to fix the damper, wherein the damper fixing member comprises a first flange portion and a second flange portion formed on at least a portion of the bottom plate to support opposite sides of a lower end of the damper and provided with holes through which a fixing bolt pass, respectively, and wherein at least one of the first flange portion and the second flange portion is provided with a reinforcing rib formed by protruding at least a portion thereof to reinforce strength.

The hole formed on the first flange portion may be a through hole through which the fixing bolt passes, and the hole formed on the second flange portion may be provided with threads to fix the fixing bolt.

The reinforcing rib may be positioned at an upper portion of at least one of the first flange portion and the second flange portion and may protrude horizontally.

The reinforcing rib may include a first rib horizontally positioned and a second rib extending vertically from opposite ends of the first rib.

The reinforcing rib may include at least one of an I shape and a U shape.

The reinforcing rib may be formed by a press process on at least one of the first flange portion and second flange portion.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various drawings of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

Hereinafter, embodiments of the disclosure will be described in detail with reference to the accompanying drawings.

Figure 1:
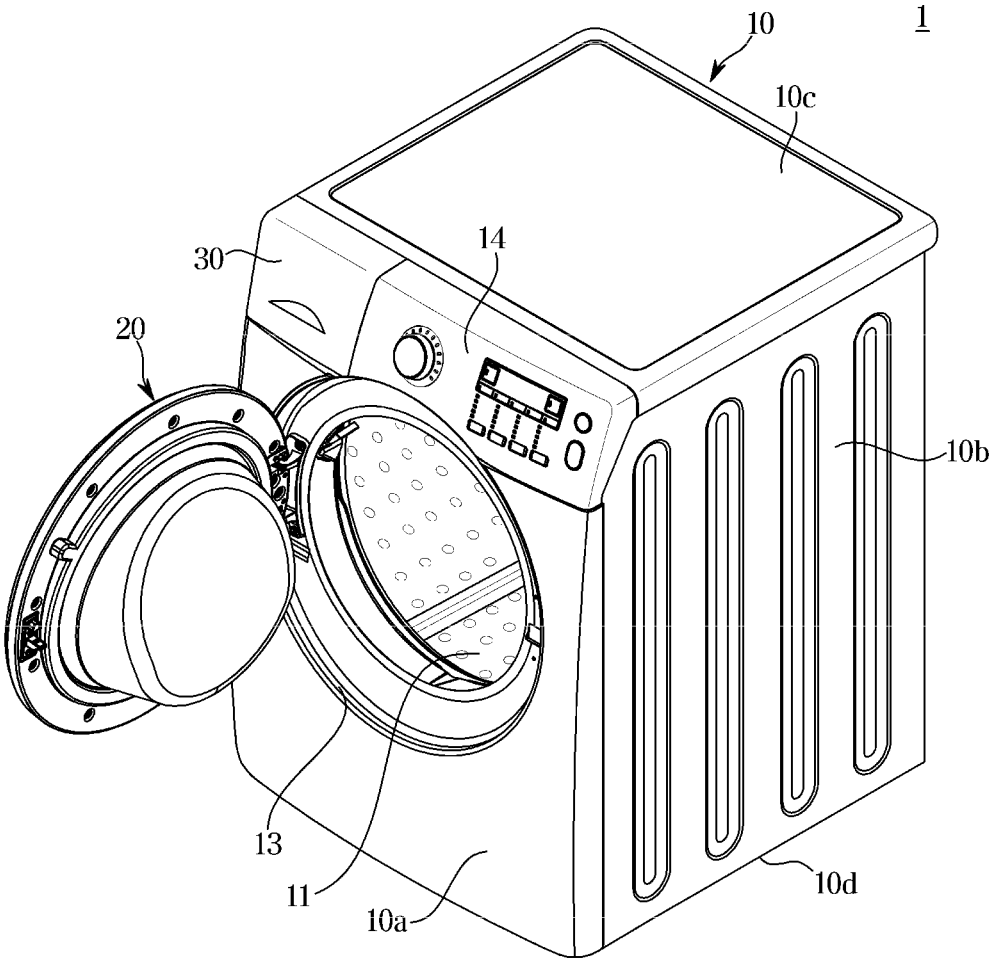
FIG. 1 is a perspective view of a washing machine according to an embodiment of the disclosure.
Figure 2:
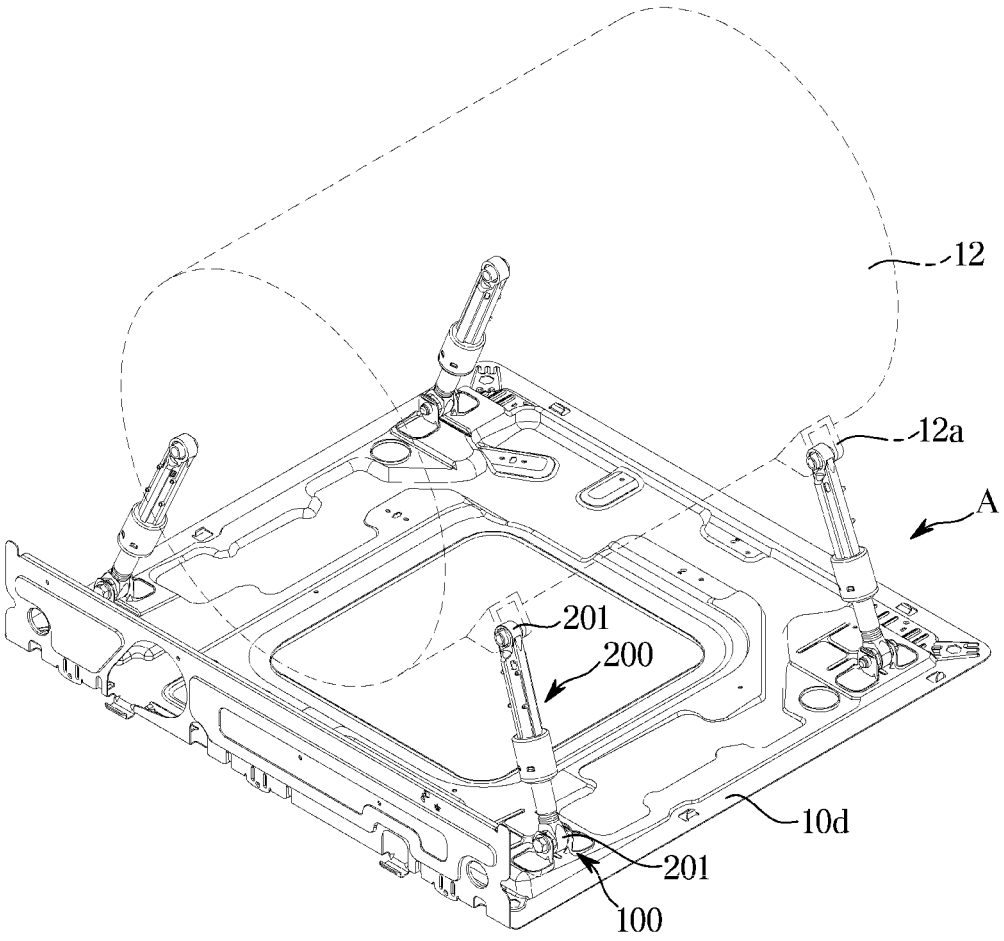
FIG. 2 is a perspective view of dampers and a bottom plate of the washing machine according to an embodiment of the disclosure.

FIG. 1 is a perspective view of a washing machine according to an embodiment of the disclosure, and FIG. 2 is a perspective view of dampers and a bottom plate of the washing machine according to an embodiment of the disclosure.

As illustrated in FIGS. 1 and 2, a washing machine 1 includes a main body 10 forming an outer appearance, a tub 12 installed inside the main body 10 to receive washing water, and a drum 11 of a cylindrical shape rotatably installed inside the tub 12 and having a plurality of dehydration holes formed on a wall surface.

The main body 10 is formed in a substantially hexahedral shape. The main body 10 may include a front surface 10*a*, a rear surface (not shown), opposite side surfaces 10*b*, an upper surface 10*c*, and a bottom plate 10*d* forming a bottom.

An opening 13 may be formed on the front surface 10*a* of the main body 10 to allow laundry to be put in or out. Openings may be formed in the tub 12 and the drum 11, respectively, such that laundry may be put in or out through the front of the main body 10, and the openings of the tub 12 and the drum 11 may be positioned to correspond to the opening 13 of the front surface 10*a*.

A door 20 for opening and closing the openings of the tub 12 and the drum 11 is mounted on the opening 13 of the main body 10.

A control panel 14 for controlling the operation of the washing machine 1 may be provided on an upper side of the front surface 10*a* of the main body 10.

A driving unit (not shown) may be provided in the rear of the drum 11. The driving unit, which is configured to rotate the drum 11, may rotate the drum 11 by transmitting a driving force generated by a motor to a rotating shaft.

Although not shown, a water supply valve (not shown) and water supply pipes for controlling water supply, and a detergent supply device 30 for supplying a detergent into the tub 12 in a water supply process may be installed above the tub 12.

A drainage device (not shown) including a drain pipe (not shown) and a drain valve (not shown) for draining water in the tub 12 may be installed below the tub 12.

Although an embodiment of the disclosure illustrates that the front surface 10*a*, the rear surface, the opposite side surfaces 10*b*, the upper surface 10*c*, and the bottom plate 10*d*, which form the main body 10, are provided separately and assembled, the disclosure is not limited thereto. For example, at least some of the front surface 10*a*, the rear surface, the opposite side surfaces 10*b*, the upper surface 10*c*, and the bottom plate 10*d* of the main body 10 may be integrally formed.

The tub 12 may be elastically supported on the main body 10 by a spring (not shown) connected to an upper portion thereof and a damper 200 connected to a lower portion thereof. That is, the spring and the damper 200 may absorb vibration energy between the tub 12 and the main body 10 to dampen vibration transmitted to the main body 10 when the vibration generated by the rotation of the drum 11 are transmitted to the tub 12 and the main body 10.

The damper 200 supporting the lower portion of the tub 12 may be provided in a plurality of numbers. Vibration and shaking of the tub 12 generated during the washing process may not be transmitted to the main body 10 by the dampers 200. The damper 200 may include a first fixing portion 201 formed at an upper end thereof and a second fixing portion 202 formed at a lower end thereof. Damper supports 12*a* may be provided on an outer surface of the tub 12 to support upper portions of the dampers 200. The first fixing portion 201 of the damper 200 may be supported on the damper support 12*a* of the tub 12. The damper support 12*a* of the tub 12 may be provided to correspond to the first fixing portion 201 of the damper 200. The second fixing portion 202 of the damper 200 may be supported on a damper fixing member 100 formed on the bottom plate 10*d*.

As illustrated in FIG. 2, the dampers 200 may be fixed through the damper fixing members 100 formed on the bottom plate 10*d* of the main body 10. The damper fixing members 100 may be disposed at corners of the bottom plate 10*d* of the main body 10, respectively. The damper fixing members 100 may be provided to correspond to the dampers 200. An embodiment of the disclosure illustrates that four of the dampers 200 and four of the damper fixing members 100 are provided, but the disclosure is not limited thereto.

Four of the dampers 200 may be disposed to support the front, rear, left, and right sides of the lower portion of the tub 12. The dampers 200 may be disposed at four of the corners of the bottom plate 10*d* to support opposite front and rear sides of the lower portion of the tub 12.

Figure 3:
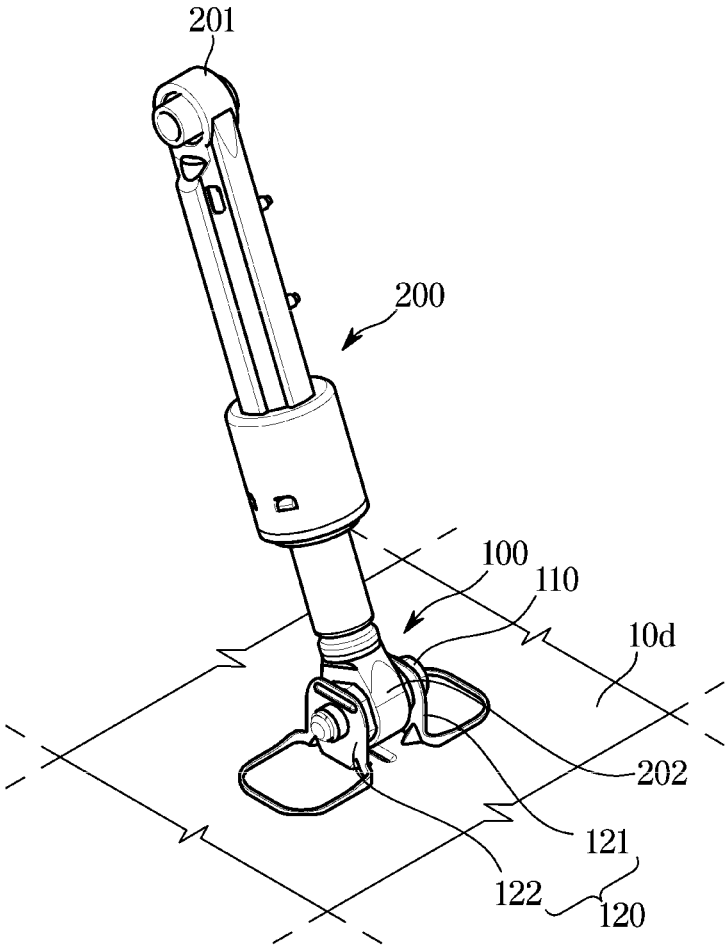
FIG. 3 is an enlarged view of a portion A in FIG. 2, illustrating a configuration of the damper and a damper fixing member according to an embodiment of the disclosure.
Figure 4:
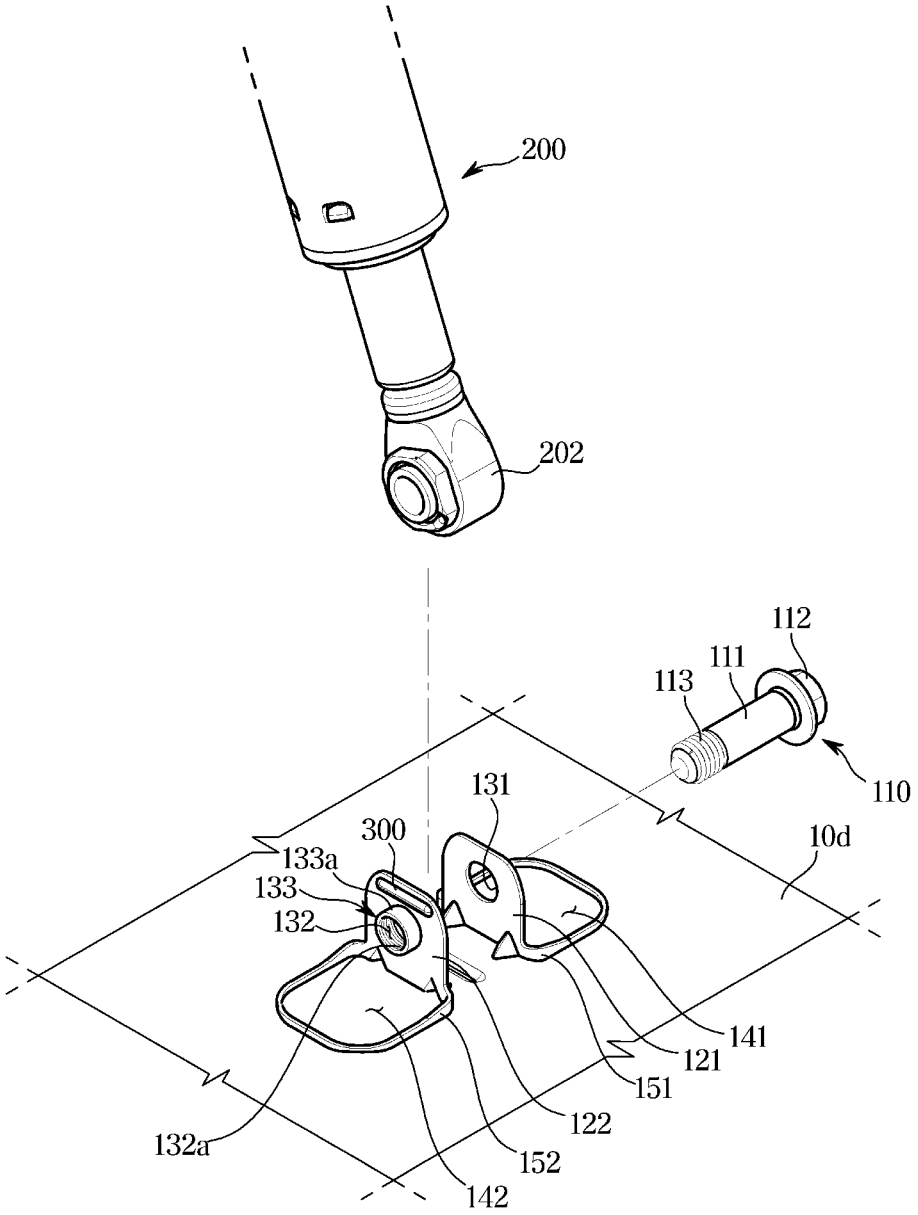
FIG. 4 is an exploded perspective view of the damper fixing member according to an embodiment of the disclosure.
Figure 5:
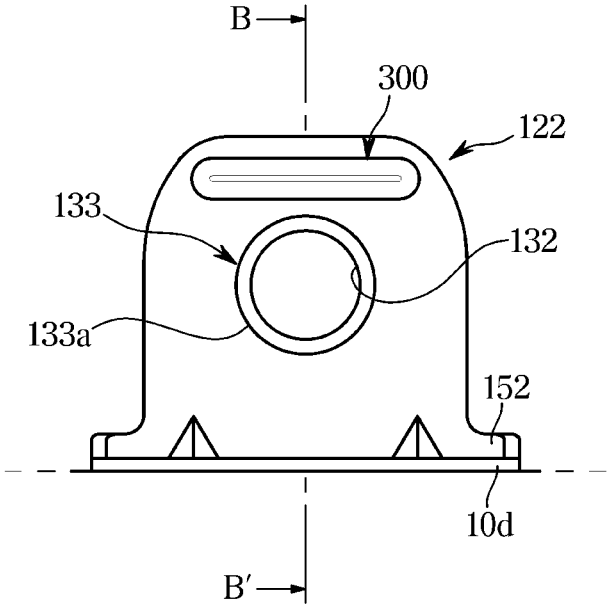
FIG. 5 illustrates a reinforcing rib of the damper fixing member according to an embodiment of the disclosure.
Figure 6:
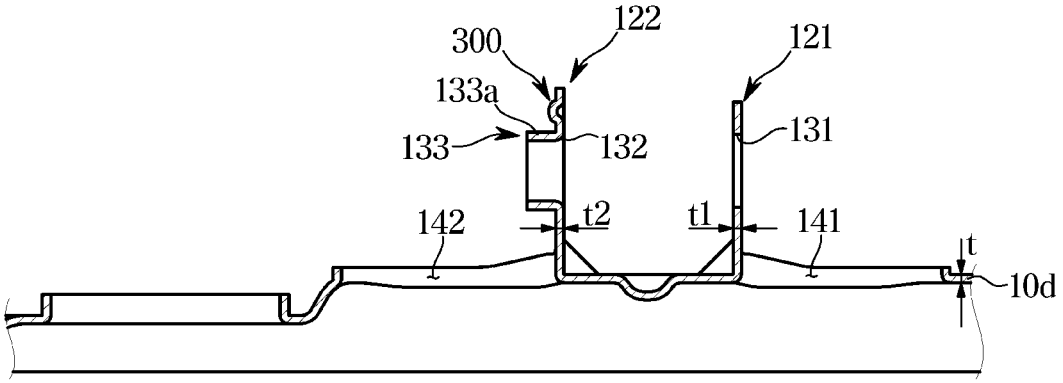
FIG. 6 is a cross-sectional view taken along line B-B' in FIG. 5.

FIG. 3 is an enlarged view of a portion A in FIG. 2, illustrating a configuration of the damper and a damper fixing member according to an embodiment of the disclosure, FIG. 4 is an exploded perspective view of the damper fixing member according to an embodiment of the disclosure, FIG. 5 illustrates a reinforcing rib of the damper fixing member according to an embodiment of the disclosure, and FIG. 6 is a cross-sectional view taken along line B-B' in FIG. 5.

As illustrated in FIGS. 3 to 6, for fixing the damper 200, the damper fixing member 100 disposed on the bottom plate 10*d* of the main body 10 may be provided.

The damper fixing member 100 may include a fixing bolt 110, and a flange 120 through which the fixing bolt 110 passes to support the damper 200. The damper fixing member 100 includes the flange 120 protruding slantingly upward from the bottom plate 10*d* to support opposite sides of the lower end of the damper 200. The flange 120 may include a first flange portion 121 and a second flange portion 122. The first flange portion 121 may be formed on at least a portion of the bottom plate 10*d* to support one side of the lower end of the damper 200. The second flange portion 122 may be formed on at least a portion of the bottom plate 10*d* to support the other side of the lower end of the damper 200.

The first flange portion 121 may include a first hole 131 formed to allow the fixing bolt 110 to pass through. The first hole 131 may form a through hole to allow the fixing bolt 110 to pass through.

The second flange portion 122 may disposed to face the first flange portion 121 to support the other side of the lower end of the damper 200. The second flange portion 122 may include a second hole 132 formed to allow the fixing bolt 110 to be fastened. The second flange portion 122 may further include a coupling portion 133 formed on the second hole 132 to couple with the fixing bolt 110. Threads 132 to which at least a portion of the fixing bolt 110 is fastened may be formed on the coupling portion 133, The coupling portion 133 may include a support surface 133*a* on which the threads 132 are formed therein. The support surface 133*a* may be connected to the second hole 132. The threads 132 of the support surface 133*a* may be connected to the second hole 132. The support surface 133*a* may be formed to be integrally connected to the second hole 132.

The first flange portion 121 and the second flange portion 122 may be formed by cutting at least a portion of the bottom plate 10*d*. The first flange portion 121 and the second flange portion 122 may include cut portions 141 and 142 formed by cutting at least a portion of the bottom plate 10*d*, respectively. The cut portions 141 and 142 may include the first cut portion 141 formed by the first flange portion 121 and the second cut portion 142 formed by the second flange portion 122.

Reinforcing portions 151 and 152 for reinforcing may be formed at edges of the first cut portion 141 and the second cut portion 142, respectively. The reinforcing portions 151 and 152 may be formed to protrude upward from circumferences of the first cut portion 141 and the second cut portion 142, respectively. The first reinforcing portion 151 may be formed at the circumference of the first cut portion 141. The second reinforcing portion 152 may be formed at the circumference of the second cut portion 142. The first reinforcing portion 151 and the second reinforcing portion 152 may be integrally connected to lower portions of the first and second flange portions 121 and 122, respectively. That is, the first reinforcing portion 151 and the second reinforcing portion 152 are formed continuously along the circumferences of the first cut portion 141 and the second cut portion 142 to have a height greater than a thickness of the bottom plate 10*d* and may be connected to the first flange portion 121 and the second flange portion 122, respectively.

The first reinforcing portion 151 and the second reinforcing portion 152 may reinforce the weakening of strength due to the first cut portion 141 and the second cut portion 142 of the bottom plate 10*d*, so that even when a large load or impact is applied to the first flange portion 121 and the second flange portion 122 through the damper 200, damage around the first cut portion 141 and the second cut portion 142 may be prevented.

As such, the first and second flange portions 121 and 122 and the bottom plate 10*d* are connected each other by the first reinforcing portion 151 and the second reinforcing portion 152, thereby greatly improving the strength of the first and second flange portions 121 and 122.

A thickness t of the bottom plate 10*d* may be formed to be 1.2 mm or less. The bottom plate 10*d* may be molded through a conventional press process. Thicknesses t1 and t2 of the first flange portion 121 and the second flange portion 122 may be formed to be the same as the thickness t of the bottom plate 10*d*. Because the first flange portion 121 and the second flange portion 122 can be simultaneously molded during a press process of the bottom plate 10*d*, the first flange portion 121 and the second flange portion 122 may be molded without a separate manufacturing process or additional processing. The thicknesses t1 and t2 of the first flange portion 121 and the second flange portion 122 may be formed to be 1.2 mm or less.

The fixing bolt 110 may include a cylindrical bolt body 111, a bolt head portion 112 formed at one end of the bolt body 111, and a screw portion 113 formed at the other end of the bolt body 111. The screw portion 113 may be formed by a predetermined length at the other end of the bolt body 111. The screw portion 113 may be formed at the other end of the fixing bolt 110.

The screw portion 113 of the fixing bolt 110 is fastened to the coupling portion 133 formed on the second hole 132 of the second flange portion 122 by passing the second fixing portion 202 of the damper 200 through the first hole 131 of the first flange portion 121.

The first flange portion 121 and the second flange portion 122 may be formed by being connected to at least a portion of the bottom plate 10*d*. At least one of the first flange portion 121 and the second flange portion 122 may include a reinforcing rib 300 formed to reinforce strength.

The reinforcing ribs 300 of the first flange portion 121 and the second flange portion 122 may be formed by protruding at least a portion of the first flange portion 121 and the second flange portion 122. The reinforcing rib 300 may be disposed at an upper portion of the second flange portion 122. The reinforcing rib 300 may be disposed in a horizontal direction at the upper portion of the second flange portion 122. The reinforcing rib 300 may reinforce the strength of the second flange portion 122 by protruding in the horizontal direction at the upper portion of the second flange portion 122.

The reinforcing rib 300 may protrude in the horizontal direction above the coupling portion 133. The reinforcing rib 300 may be formed in an I shape. A cross section of the reinforcing rib 300 may include a semicircle shape or a square shape. The reinforcing rib 300 may include a U shape. The reinforcing rib 300 may be disposed around the coupling portion 133. The reinforcing rib 300 may further enhance the strength of the coupling portion 133 of the second flange portion 122. The reinforcing rib 300 may improve the fastening force of the fixing bolt 110 coupled to the coupling portion 133 of the second flange portion 122, thereby generating a force resistant to the rotation of the damper 200 and maximizing the vibration damping effect.

Figure 7:
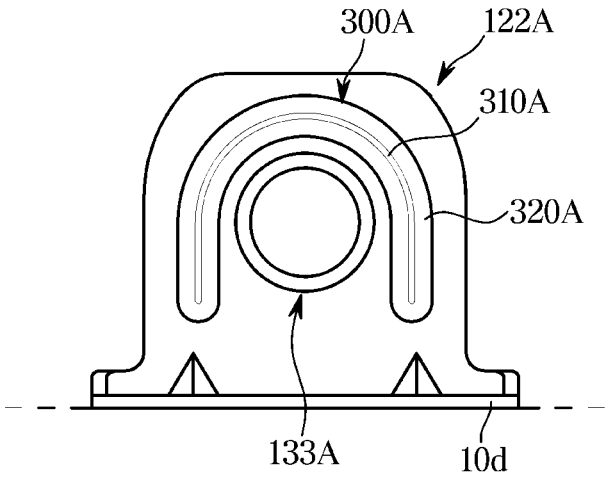
FIG. 7 illustrates a reinforcing rib of the damper fixing member according to another embodiment of the disclosure.

FIG. 7 illustrates a reinforcing rib of the damper fixing member according to another embodiment of the disclosure. Reference numerals not shown in FIG. 7 will be described with reference to FIGS. 1 to 6.

As illustrated in FIG. 7, the damper fixing member 100 formed on the bottom plate 10*d* to fix the damper 200 may include the flange 120 through which the fixing bolt 110 passes to support the damper 200. The damper fixing member 100 includes the flange 120 protruding slantingly upward from the bottom plate 10*d* to support the opposite sides of the lower end of the damper 200. The flange 120 may include the first flange portion 121 and a second flange portion 122A. The first flange portion 121 may be formed on at least a portion of the bottom plate 10*d* to support one side of the lower end of the damper 200. The second flange portion 122A may be formed on at least a portion of the bottom plate 10*d* to support the other side of the lower end of the damper 200.

At least one of the first flange portion 121 and the second flange portion 122A may include a reinforcing rib 300A formed to reinforce strength.

The reinforcing rib 300A may be formed by protruding at least a portion of the second flange portion 122. The reinforcing rib 300A may be disposed around a coupling portion 133A of the second flange portion 122A. The reinforcing rib 300A may be provided to reinforce the strength of the second flange portion 122A. The reinforcing rib 300A may include a U shape. The reinforcing rib 300A may include a first rib 310A disposed in the horizontal direction above the coupling portion 133A, and a second rib 320A disposed in the vertical direction from opposite ends of the first rib 310A. The reinforcing rib 300A is formed to protrude from the periphery of the coupling portion 133A to reinforce the strength of the second flange portion 122A.

As is apparent from the above, according to an embodiment of the disclosure, the structure of a damper fixing member can be improved to stably maintain the fastening of a damper fixing member, thereby reducing vibration and noise.

Further, the strength is reinforced by a reinforcing rib formed on the damper fixing member, so that cost competitiveness can be secured by reducing the thickness of a bottom plate.

Further, because the reinforcing rib can be integrally formed in the process of forming the damper fixing member on the bottom plate, the strength of the damper fixing member can be reinforced without a separate manufacturing process or additional cost.

While the disclosure has been particularly described with reference to exemplary embodiments, it should be understood by those of skilled in the art that various changes in form and details may be made without departing from the spirit and scope of the disclosure.

What is claimed is:

1. A washing machine comprising:

a main body in which a tub is installed, and having a bottom plate;

a damper provided in the main body to support the tub; and a damper fixing member, provided on the bottom plate to fix the damper to the bottom plate, comprising:

a bolt, a first flange portion on the bottom plate to support a first side of a lower end of the damper and provided with a first through hole through which the bolt passes, a second flange portion on the bottom plate and facing the first flange portion to support a second side of the lower end of the damper, and provided with a second through hole through which the bolt passes and a coupling portion to which the bolt is fastened and which is formed to be integrally connected to the second through hole, and a reinforcing rib disposed on at least one of an upper portion of the first flange portion above the first through hole and an upper portion of the second flange portion above the coupling portion, wherein the coupling portion has a cylinder shape and protrudes in a direction opposite of the first flange portion.

2. The washing machine according to claim 1, wherein the reinforcing rib protrudes from the at least one of the first flange portion and the second flange portion.

3. The washing machine according to claim 1, wherein the coupling portion comprises threads to fasten the bolt.

4. The washing machine according to claim 1, wherein the coupling portion comprises a support surface to support the bolt.

5. The washing machine according to claim 1, wherein the reinforcing rib is integrally formed with the second flange portion.

6. The washing machine according to claim 5, wherein the reinforcing rib is disposed on the upper portion of the second flange portion and protrudes horizontally from the second flange portion.

7. The washing machine according to claim 5, wherein the reinforcing rib has at least one of an I shape and a U shape.

8. The washing machine according to claim 5, wherein the reinforcing rib has at least one of a square cross-sectional shape and a circular cross-sectional shape.

9. The washing machine according to claim 1, wherein the reinforcing rib is disposed on the upper portion of the second flange portion and extends in a horizontal direction, and the damper fixing member further comprises:

a first rib disposed on the second flange portion which extends vertically from one end of the reinforcing rib disposed on the upper portion of the second flange portion and extending in the horizontal direction; and a second rib disposed on the second flange portion which extends vertically from another end of the reinforcing rib disposed on the upper portion of the second flange portion and extending in the horizontal direction.

10. The washing machine according to claim 1, wherein thicknesses t1 and t2 of the first flange portion and the second flange portion are 1.2 mm or less.

11. The washing machine according to claim 1, wherein a thickness t of the bottom plate is 1.2 mm or less.

12. The washing machine according to claim 1, wherein the reinforcing rib is disposed entirely above the coupling portion.

13. The washing machine according to claim 1, wherein the reinforcing rib is disposed on the upper portion of the second flange portion so as to circumferentially surround at least an upper portion of the coupling portion.

14. The washing machine according to claim 1, wherein the reinforcing rib is formed by a press process on the at least one of the first flange portion and the second flange portion.

15. A washing machine comprising:

a main body in which a tub is installed, and having a bottom plate;

a damper provided in the main body to support the tub; and a damper fixing member, provided on the bottom plate to fix the damper to the bottom plate, comprising:

a first flange portion on the bottom plate and having a first hole, to support a first side of a lower end of the damper, a second flange portion on the bottom plate and having a second hole, to support a second side, opposite to the first side, of the lower end of the damper, and a coupling portion which is formed to be integrally connected to the second hole, a bolt passing through the first hole and the second hole, and a reinforcing rib protruding from at least one of an upper portion of the first flange portion above the first hole and an upper portion of the second flange portion above the coupling portion, wherein the coupling portion has a cylinder shape and protrudes in a direction opposite of the first flange portion.

16. The washing machine according to claim 15, wherein the second hole of the second flange portion is provided with threads to fix the bolt.

17. The washing machine according to claim 15, wherein the reinforcing rib protrudes horizontally from the at least one of the upper portion of the first flange portion above the first hole and the upper portion of the second flange portion above the second hole.

18. The washing machine according to claim 15, wherein the reinforcing rib is disposed on the upper portion of the first flange portion and extends in a horizontal direction, and the damper fixing member further comprises:

a first rib disposed on the first flange portion which extends vertically from one end of the reinforcing rib disposed on the upper portion of the first flange portion and extending in the horizontal direction; and a second rib disposed on the first flange portion which extends vertically from another end of the reinforcing rib disposed on the upper portion of the first flange portion and extending in the horizontal direction.

19. The washing machine according to claim 15, wherein the reinforcing rib has at least one of an I shape and a U shape.

20. The washing machine according to claim 15, wherein the reinforcing rib is formed by a press process on the at least one of the first flange portion and the second flange portion.

* * * * *